US009151285B2

(12) United States Patent
Wu

(10) Patent No.: US 9,151,285 B2
(45) Date of Patent: Oct. 6, 2015

(54) AIR PUMP STRUCTURE

(75) Inventor: Shang-Neng Wu, Pingzhen (TW)

(73) Assignee: AIR KINETIC TECHNOLOGIES CORP., Taoyuan County (TW)

( * ) Notice: Subject to any disclaimer, the term of this patent is extended or adjusted under 35 U.S.C. 154(b) by 180 days.

(21) Appl. No.: 13/355,345

(22) Filed: Jan. 20, 2012

(65) Prior Publication Data

US 2013/0189135 A1 Jul. 25, 2013

(51) Int. Cl.
*F04B 45/047* (2006.01)
*F04B 45/04* (2006.01)
*F04B 53/16* (2006.01)

(52) U.S. Cl.
CPC ..... *F04B 45/043* (2013.01); *F04B 53/164* (2013.01); *F04B 45/047* (2013.01)

(58) Field of Classification Search
CPC ..... F04B 45/024; F04B 23/04; F04B 41/06; F04B 43/02; F04B 43/025; F04B 43/026; F04B 45/043; F04B 45/047
USPC ..... 417/413.1, 531, 533, 534
See application file for complete search history.

(56) References Cited

U.S. PATENT DOCUMENTS

| | | | | |
|---|---|---|---|---|
| 4,154,559 | A * | 5/1979 | Enomoto | 417/413.1 |
| 5,052,904 | A * | 10/1991 | Itakura et al. | 417/363 |
| 5,353,838 | A * | 10/1994 | Grant | 137/624.13 |
| 5,730,587 | A * | 3/1998 | Snyder et al. | 417/413.1 |
| 6,364,637 | B1 * | 4/2002 | Hase et al. | 417/413.1 |
| 8,047,813 | B2 * | 11/2011 | Sevy | 417/363 |
| 2009/0281483 | A1 * | 11/2009 | Baker et al. | 604/28 |

* cited by examiner

*Primary Examiner* — Bryan Lettman
*Assistant Examiner* — Charles W Nichols
(74) *Attorney, Agent, or Firm* — Chun-Ming Shih

(57) ABSTRACT

An air pump structure includes a main body. The main body has a central air chamber. The main body has two side air chambers at two sides thereof. The two side air chambers communicate with the central air chamber through an air inlet unit. The two side air chambers each have a passage at a lower end thereof to communicate with an air outlet. A one-way valve plate is coupled to the air outlet. Two air pump members are to seal the two side air chambers. The air pump members cooperate with a link member and an electromagnetic member to pump air. The present invention has a simple configuration and lowers the cost and is convenient for assembly to enhance its quality and prevent air leakage.

7 Claims, 4 Drawing Sheets

AIR PUMP STRUCTURE

BACKGROUND OF THE INVENTION

1. Field of the Invention

The present invention relates to an air pump structure, and more particularly to a simplex air pump structure instead of a conventional complicated air pump.

2. Description of the Prior Art

An air pump is widely used to generate air flow, such as an air pump device for an air blower, a fish jar or the like.

As shown in FIG. 1 and FIG. 2, a conventional air pump structure 1 comprises two side bodies 11, a seal membrane member 12 located between the two side bodies 11, two pump lids 13 to seal the two side bodies 11, two link members 14 connected with the two pump lids 13, and an electromagnetic member 15. Each side body 11 has an air intake space 111, a membrane piece 1111, an air exhaling space 112, an inner air input space 113, a distal air input space 114, an exhaust pipe 115, and an air valve 116. When in use, the electromagnetic member 15 is electrified to link the link members 14 to reciprocate because of magnetic action. The pump lids 13 are linked to reciprocate relative to the two side bodies 11. When the pump lids 13 are deformed from inside to outside to generate a suction force, the membrane piece 1111 is opened and the air enters the air intake space 111 from the outside. When the pump lid 13 is deformed from outside to inside to generate a compressed force, the membrane piece 1111 is closed and the air is exhausted from the air exhaling space 1112. The air passes the inner air input space 113, the distal air input space 114 and the exhaust pipe 115 to be exhausted from the air valve 116. The conventional air pump structure 1 has been used several decades, which has the following drawbacks:

1. This structure comprises two side bodies 11, a seal membrane member 12 located between the two side bodies 11. When these three parts are assembled, the assembled position may be incorrect. After using for a long time, the structure may loosen because of vibration to case air leakage. This results in less air volume. Sometimes, the pump malfunctions.

2. This structure has many parts including the two side bodies 11, the seal membrane member 12, the exhaust pipe 115, and so on. The mold expense is high, and the storage cost is also increased. The cost cannot be lowered, and it takes a lot of time and work to assemble the parts.

3. This structure needs a fastening band to fix the pump lid 13. It is troublesome to assemble the parts. If the fastening bank is cut off, the pump lid 13 will lose its function.

4. The diameter of the air intake pipe of this structure is small, which is unable to filter impurities in the air. The dust in the air will cause that the membrane piece cannot be closed exactly and may malfunction over a long period of time.

Accordingly, the inventor of the present invention has devoted himself based on his many years of practical experiences to solve these problems.

SUMMARY OF THE INVENTION

The primary object of the present invention is to provide an improved air pump structure which has a simple configuration and few parts to lower the mold cost and to prevent air leakage and has a long service life.

In order to achieve the aforesaid object, the air pump structure of the present invention comprises a main body. The main body has a central air chamber. The central air chamber provides an air intake function. The main body has two side air chambers at two sides thereof. The two side air chambers and the central air chamber are separated. Each side air chamber has an air inlet unit. Through the air inlet unit, the two side air chambers communicate with the central air chamber. The air inlet unit is covered with a one-way membrane member. The two side air chambers each have a passage at a lower end thereof to communicate with an air outlet. A one-way valve plate is coupled to the air outlet. Two air pump members are to seal the two side air chambers. The air pump members cooperate with a link member and an electromagnetic member to pump air.

Preferably, the two side air chambers each have a circle shape, and the central air chamber is located between the two side air chambers.

Preferably, the central air chamber has an open top, and a cotton filter is provided in the central air chamber.

Preferably, the air outlet is disposed at the bottom of the passage.

Preferably, the air inlet unit has a post extending outward from a central portion thereof. The post is for connection of a positioning block of the one-way membrane member. The one-way membrane member exactly covers the outer edge of the air inlet unit. The one-way membrane member cooperates with the air inlet unit for air to flow from the central air chamber to the side air chambers. The air is unable to flow back from the side air chambers to the central air chamber.

Preferably, through the one-way valve plate, the air is expelled from the passage to the air outlet and unable to flow back from the air outlet to the passage.

Preferably, the air pump member is made of a soft material. The center of the air pump member is connected with a link member. The link member is connected with an electromagnetic member.

Preferably, the air pump member is coupled to an open portion of a seat of the main body to connect with the side air chambers.

The advantages of the present invention are as follow:

1. The present invention uses the single main body instead of the conventional structure having the two side bodies and the seal membrane member between the two side bodies. The parts of the present invention are decreased. The number and cost of the molds are lowered, and it is convenient to assemble the parts.

2. The present invention uses the single main body instead of the conventional structure having the two side bodies and the seal membrane member between the two side bodies, without using the seal membrane member for seal. The quality of the present invention is enhanced, not having the consideration of air leakage. The service life can be prolonged.

3. The air passes the passage and the air outlet, and then outputs. Compared to the conventional structure which needs the exhaust pipe, the present invention is more ideal.

4. The present invention uses the single main body instead of the conventional structure having the two side bodies and the seal membrane member between the two side bodies. The present invention has an integral configuration instead of the separate configuration of the prior art. The central air chamber, the passage and the air outlet of the present invention are also improved and novel.

5. The conventional structure needs the fastening band to fix the pump lid, which is troublesome. If the fastening band is cut off, the pump lid will lose its function. On the contrary, the air pump member of the present invention is fixed through the seat. It is convenient to assemble the present invention. The seal is exact and the structure is durable after a long period of time.

6. The central air chamber of the present invention is wide and provided with a cotton filter to filter the dust in the pair, so the membrane member won't be influenced by the dust to have an exact operation.

DETAILED DESCRIPTION OF THE PREFERRED EMBODIMENTS

Embodiments of the present invention will now be described, by way of example only, with reference to the accompanying drawings.

Figure 1:
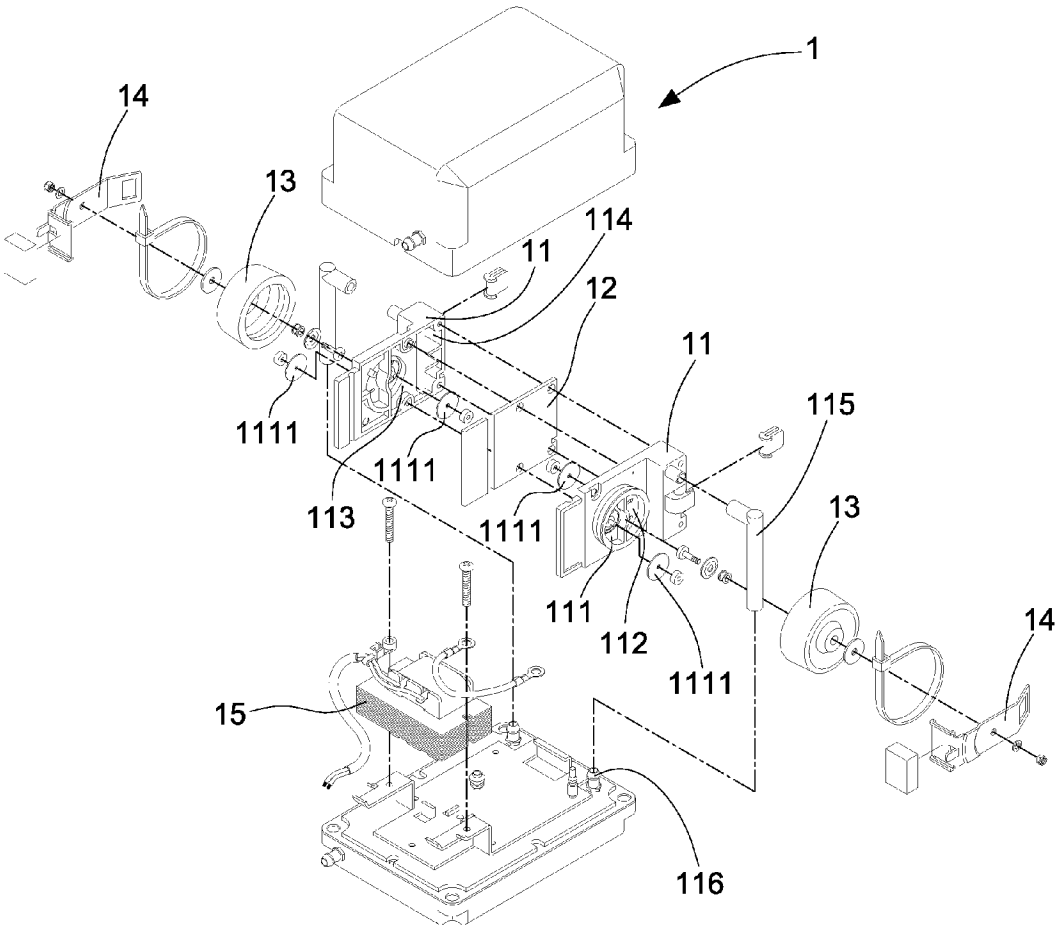
Fig.1 (Prior Art)
FIG. 1 is an exploded view of a conventional air pump.
Figure 2:
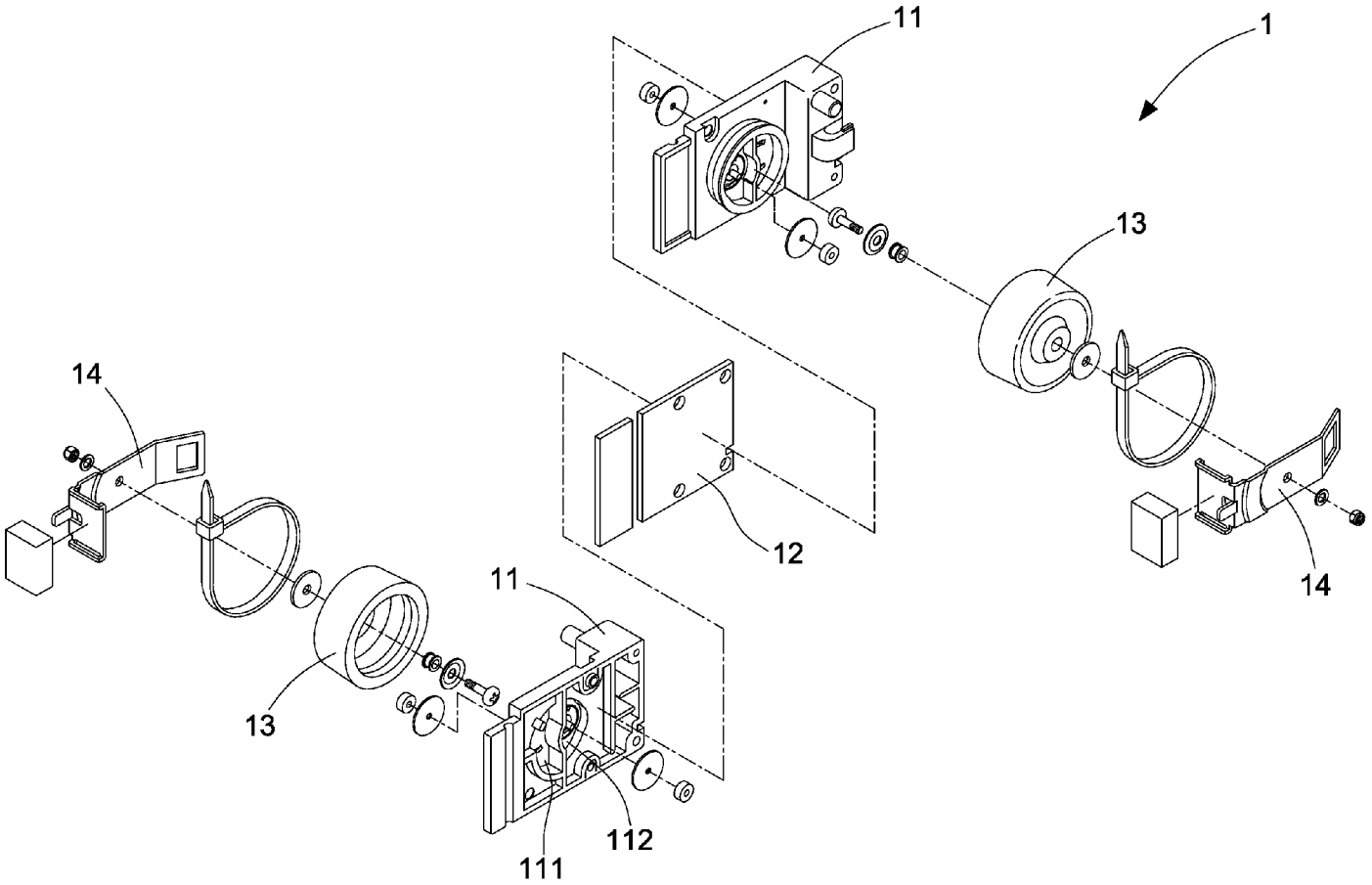
Fig.2 (Prior Art)
FIG. 2 is an enlarged exploded view of the conventional air pump.
Figure 3:
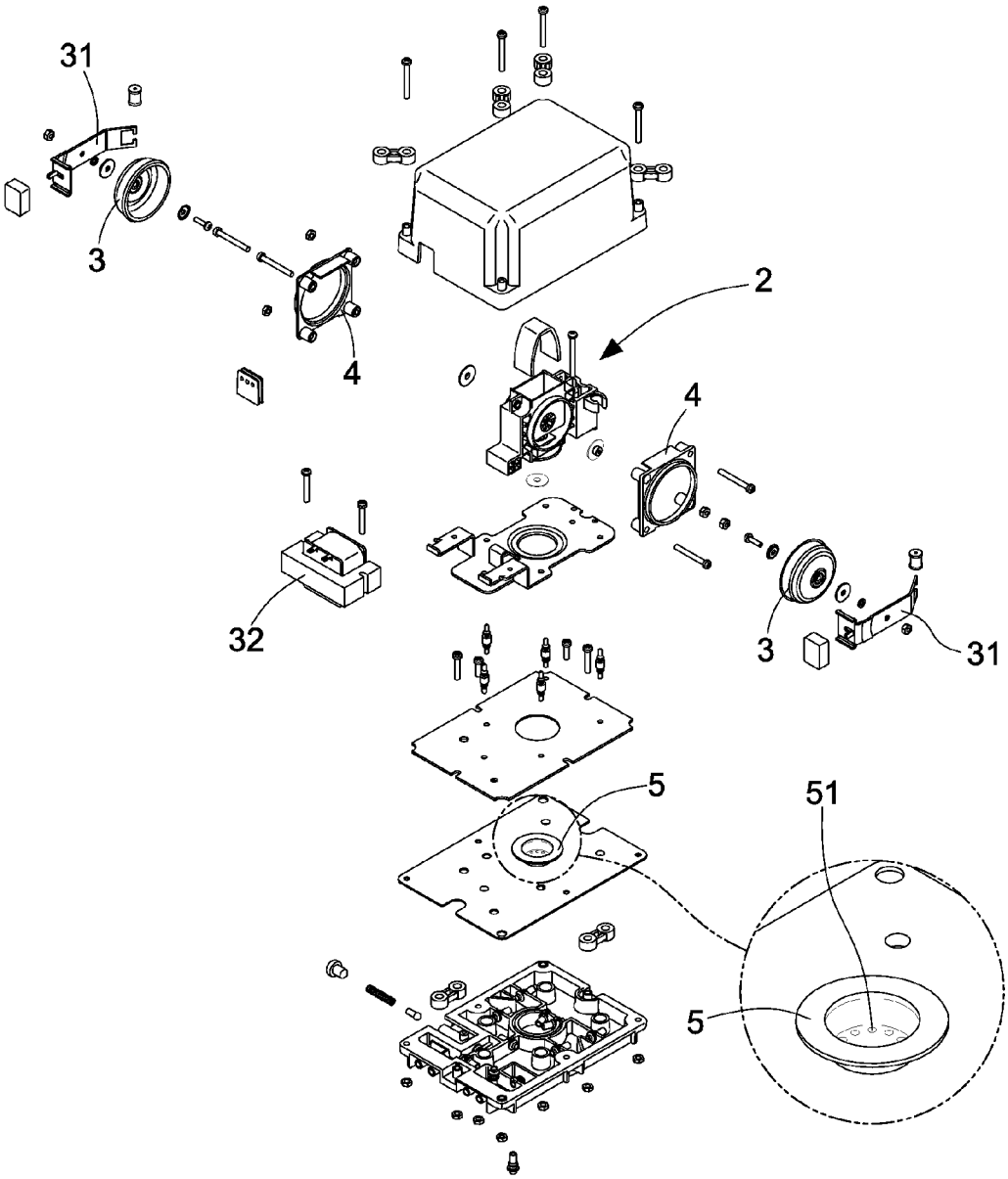
FIG. 3 is an exploded view of the present invention.
Figure 4:
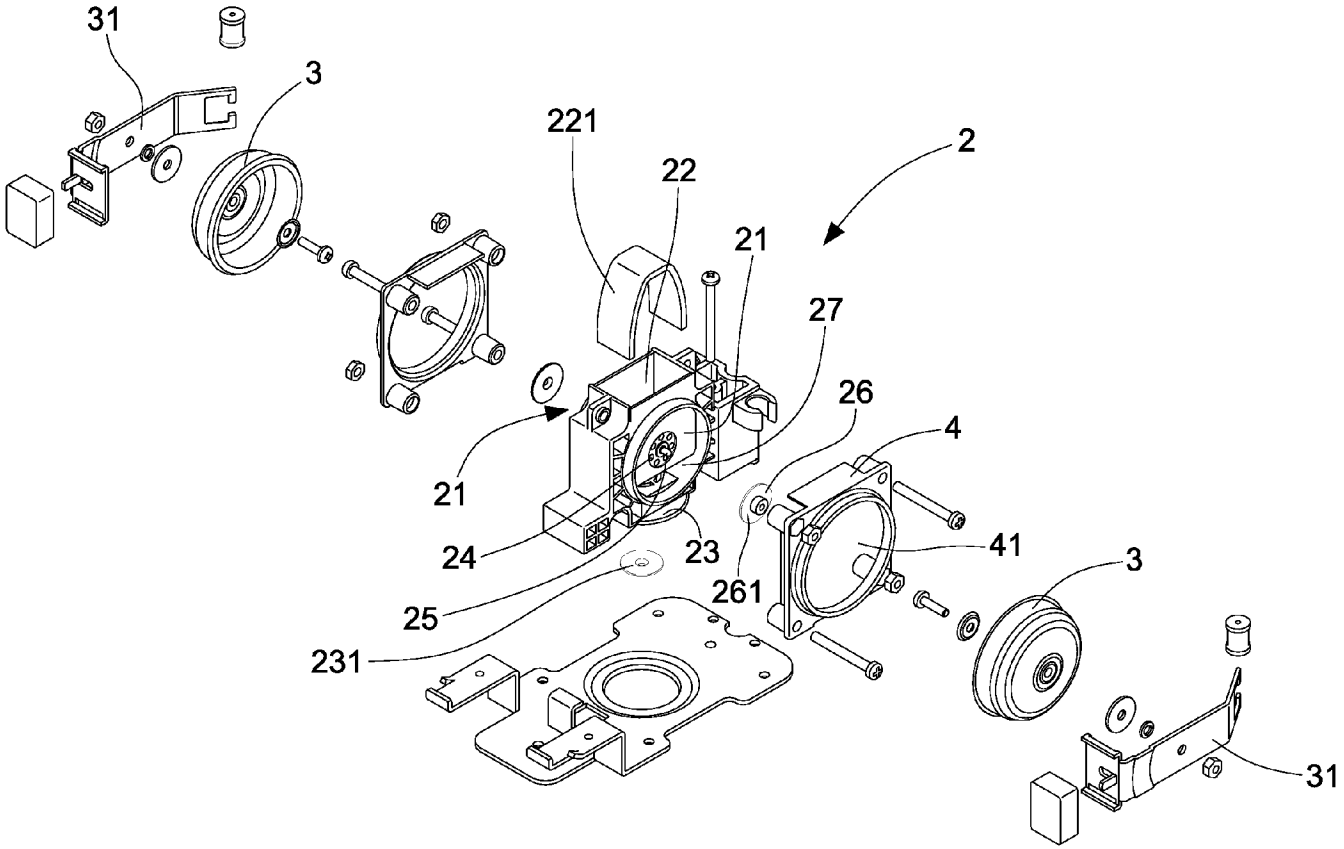
FIG. 4 is an enlarged exploded view of the present invention.

As shown in FIG. 3 and FIG. 4, the air pump structure according to a preferred embodiment of the present invention comprises a main body 2. The main body 2 has two side air chambers 21 at two sides thereof. Each side air chamber 21 has a circle shape. The main body 2 has a central air chamber 21 at a central portion thereof. A cotton filter 221 is provided in the central air chamber 22. The central air chamber 22 has an open top, and is located between the two side air chambers 21. The two side air chambers 21 and the central air chamber 22 are separated. Each side air chamber 21 has an air inlet unit 24. Through the air inlet unit 24, the two side air chambers 21 communicate with the central air chamber 22. Each side air chamber 21 has a passage 27 at a lower end thereof and an air outlet 23 at the central bottom of the passage 27.

The air inlet unit 24 has a post 25 extending outward from a central portion thereof. The post 25 is adapted for connecting a positioning block 261 of a one-way membrane member 26. The one-way membrane member 26 exactly covers an outer edge of the air inlet unit 24. The one-way membrane member 26 cooperates with the air inlet unit 24 for one-way air flow from the central air chamber 22 to the side air chambers 21. The air cannot flow back from the side air chambers 21 to the central air chamber 22.

The air outlet 23 is covered with a one-way valve plate 231 which has the same function like the one-way membrane member 26. Through the one-way valve plate 231, the air is expelled from the passage 27 to the air outlet 23 and cannot flow back from the air outlet 23 to the passage 27.

Each side air chamber 21 is sealed and connected with an air pump member 3. The air pump member 3 is made of a soft material. The center of the air pump member 3 is connected with a link member 31. The link member 31 is connected with an electromagnetic member 32. The air pump member 3 is coupled to an open portion 41 of a seat 4 so as to connect with the relative side air chamber 21. The link member 31 is controlled by the electromagnetic member 32 to reciprocate, such that the air pump member 3 is deformed inward and outward along with reciprocation of the electromagnetic member 32.

The cotton filter 221 in the central air chamber 22 not only prevents airflow noise but also filters powders and blocks dirt to keep the interior cleanness and normal running.

When the present invention is used, the electromagnetic member 32 is electrified to bring reciprocation of the link member 31 along with deformation of the air pump member 3. When the air pump member 3 is deformed from inside to outside, the side air chambers 21 will generate a suction force. Through the suction force, the air in the central air chamber 22 passes the air inlet unit 24 and enters the side air chambers 21. At this time, the one-way membrane member 26 is opened toward outside. The one-way valve plate 231 seals the air outlet 23 due to the inner suction force. When the air pump member 3 is deformed from outside to inside, the side air chambers 21 will generate a compressed force. The air in the side air chambers 22 is compressed and the one-way membrane member 26 is closed. The air moves toward the passage 27 and passes the air outlet 23. The one-way valve plate 231 is moved toward the route of the air.

Compared to the prior art, the features of the present invention are as follow.

1. The present invention uses the single main body 2 instead of the conventional structure having the two side bodies 11 and the seal membrane member 12 between the two side bodies 11. The parts of the present invention are decreased. The number and cost of the molds are lowered, and it is convenient to assemble the parts.

2. The present invention uses the single main body 2 instead of the conventional structure having the two side bodies 11 and the seal membrane member 12 between the two side bodies 11, without using the seal membrane member 12 for seal. The quality of the present invention is enhanced, not having the consideration of air leakage. The service life can be prolonged.

3. The air passes the passage 27 and the air outlet 23, and then outputs. Compared to the conventional structure which needs the exhaust pipe 115, the present invention is more ideal.

4. The present invention uses the single main body 2 instead of the conventional structure having the two side bodies 11 and the seal membrane member 12 between the two side bodies 11. The present invention has an integral configuration instead of the separate configuration of the prior art. The central air chamber 22, the passage 27 and the air outlet 23 of the present invention are also improved and novel.

5. The conventional structure needs the fastening band to fix the pump lid 13, which is troublesome. If the fastening band is cut off, the pump lid 13 will lose its function. On the contrary, the air pump member 3 of the present invention is fixed through the seat 4. It is convenient to assemble the present invention. The seal is exact and the structure is durable after a long period of time.

6. The central air chamber of the present invention is wide and provided with a cotton filter to filter the dust in the pair, so the membrane member won't be influenced by the dust to have an exact operation.

The present invention further comprises a muffler sleeve 5 at the bottom thereof. The muffler sleeve 5 is made of a soft material, such as rubber or silicon gel. The muffler sleeve 5 has a through hole 51 for flow of air. The muffler sleeve 5 can eliminate noise.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An air pump structure, comprising:

a main body, the main body having two side air chambers at two sides thereof and a single central air chamber which communicates with each of the two side air chambers through an air inlet unit, the single central air chamber being defined by four straight side walls, an open top, and a bottom wall, at least a portion of each side air chamber being positioned beyond the bottom wall of the single central air chamber and directly open to a space underneath the bottom wall of the single central air chamber so as to form a passage underneath the bottom wall of the single central air chamber, an air outlet being provided on a bottom of the space, an opening direction toward outside of the air outlet being opposite to another opening direction toward outside of the open top of the single central air chamber;

two air pump members fitted on the two side air chambers to seal the two side air chambers, respectively;

a one-way membrane member coupled to an outer edge of the air inlet unit;

a one-way valve plate coupled to the air outlet; and a muffler sleeve disposed lower than and being corresponding to the air outlet for eliminating noise, wherein the air inlet unit is disposed in the side air chamber and has a post extending outward from a central portion thereof; the post is connected with a positioning block of the one-way membrane member, and the one-way membrane member is disposed between the post and the positioning block and in direct contact therewith, and the one-way membrane member is mounted on a plane perpendicular to the plane that the one-way valve plate is mounted, and wherein the side air chambers are configured in a manner that the air flowing out of the air inlet unit flows downwardly within the side air chambers and the passage to further pass through the air outlet.

2. The air pump structure as claimed in claim 1, wherein the two side air chambers each has a circle shape, and the single central air chamber is located between the two side air chambers.

3. The air pump structure as claimed in claim 1, wherein a cotton filter is provided in the single central air chamber.

4. The air pump structure as claimed in claim 1, wherein the one-way membrane member exactly covers the outer edge of the air inlet unit, the one-way membrane member cooperates with the air inlet unit for air to flow from the single central air chamber to the side air chamber, and the air is unable to flow back from the side air chambers to the single central air chamber.

5. The air pump structure as claimed in claim 1, wherein through the one-way valve plate, the air is expelled from the passage to the air outlet and unable to flow back from the air outlet to the passage.

6. The air pump structure as claimed in claim 1, wherein the air pump members are made of a soft material, a center portion of each air pump member being connected with a link member, the link member being connected with an electromagnetic member.

7. The air pump structure as claimed in claim 1, wherein the air pump members are coupled to an open portion of a seat of the main body to connect with the side air chambers.

* * * * *